US005594295A

United States Patent [19]

Van Gennip et al.

[11] Patent Number: 5,594,295

[45] Date of Patent: Jan. 14, 1997

[54] HIGH PRESSURE DISCHARGE LAMP WITH DISCHARGE VESSEL CENTERED WITH CLAMPING PLATES

[75] Inventors: Nicasius G. T. Van Gennip; Johannes A. A. M. Van Heeswijk; Ronald A. Plantinga, all of Eindhoven, Netherlands

[73] Assignee: U.S. Philips Corporation, New York, N.Y.

[21] Appl. No.: 376,703

[22] Filed: Jan. 23, 1995

[30] Foreign Application Priority Data

Jan. 24, 1994 [BE] Belgium ..... 09400076

[51] Int. Cl.[6] ..... H01J 5/00

[52] U.S. Cl. ..... 313/25; 313/252; 313/292

[58] Field of Search ..... 313/25, 252, 292, 313/634; 362/261

[56] References Cited

U.S. PATENT DOCUMENTS

| | | | |
|---|---|---|---|
| 2,197,760 | 4/1940 | Freedman | 313/25 |
| 2,749,462 | 6/1956 | Kenty et al. . | |
| 4,129,800 | 12/1978 | Benthem et al. | 313/25 |
| 5,055,735 | 10/1991 | De Jong et al. . | |
| 5,075,586 | 12/1991 | Jaeger et al. | 313/25 |
| 5,339,001 | 8/1994 | King et al. | 313/25 |

FOREIGN PATENT DOCUMENTS 0381265 8/1990 European Pat. Off. .

*Primary Examiner*—Sandra L. O'Shea
*Assistant Examiner*—Vip Patel
*Attorney, Agent, or Firm*—Brian J. Wieghaus

[57] ABSTRACT

The high-pressure discharge lamp has a discharge vessel (1) with seals (2) on each of which a metal clamping plate (20) is present. The discharge vessel is accommodated in an outer bulb (10) which has cylindrical portions (12). The clamping plates (20) have transversely flanged rims (24, 25) from which elastic tongues (23) extend towards the outer bulb in tangential direction and press against a cylindrical portion (12) of the outer bulb with clamping force. The clamping plates (20) render it possible to suspend the discharge vessel (1) in the outer bulb (10), keeping the discharge vessel centered and forming a buffer in the case of shocks.

15 Claims, 3 Drawing Sheets

HIGH PRESSURE DISCHARGE LAMP WITH DISCHARGE VESSEL CENTERED WITH CLAMPING PLATES

BACKGROUND OF THE INVENTION

The invention relates to a high-pressure discharge lamp including

- a discharge vessel having mutually opposed seals through each of which a current conductor extends to a respective electrode arranged in the discharge vessel;
- around the discharge vessel, an outer bulb from which conductors connected to respective current conductors issue to the exterior;
- a respective metal clamping plate on each seal, which clamping plate has a central opening through which the relevant seal is passed and mutually opposed tags along said opening which hold the seal securely, and
- elastic tongues extending away from the clamping plate and resting against a cylindrical portion of the outer bulb.

Such a high-pressure discharge lamp suitable for general lighting purposes is known from EP 0 381 265 A1.

In the known lamp, the clamping plates enclose glass tubes between them which surround the discharge vessel. The discharge vessel with said tubes and the clamping plates accordingly form a comparatively heavy component of the lamp which is supported and held in position mechanically by only one of the conductors.

To prevent this heavy component knocking against the outer bulb in the case of shocks or vibrations and damaging this bulb, elastic tongues are present on the clamping plates of the known lamp which extend longitudinally in the outer bulb.

After a shock the discharge vessel may have a skew position in the outer bulb. Friction of the elastic tongues against the outer bulb can prevent the elastic tongues from sliding back into their original position. It is not a disadvantage for the application of the lamp, however, that the discharge vessel is not centered in the outer bulb.

SUMMARY OF THE INVENTION

It is an object of the invention to provide a high-pressure discharge lamp of the kind described in the opening paragraph which has a shock-resistant construction which is readily assembled and in which the discharge vessel nevertheless occupies an accurately defined position in the outer bulb, which position is maintained also after a shock.

According to the invention, this object is achieved in that the clamping plate has rims ranged transversely thereto, from which rims the elastic tongues extend in a substantially tangential direction towards the outer bulb, while the elastic tongues press with clamping force against the outer bulb.

It was found that the clamping plates center the discharge vessel in the outer bulb, protect the lamp in the case of shocks and vibrations, and keep the discharge vessel centered. The transversely ranged rims on the clamping plate give the plate a high degree of stiffness, also with the use of comparatively thin material, whereby deformations are strongly counteracted. The substantially tangentially extending tongues keep the discharge vessel in position, also after shocks. When the tongues are elastically deformed in the case of a shock and have moved transversely along the wall of the outer bulb into a different position, they readily return to their original shape after the shock and slide in transversal direction along the wall of the outer bulb back into their original position.

An advantage of the construction of the high-pressure discharge lamp according to the invention is that the discharge vessel may be easily passed into the outer bulb up to the desired distance and be subsequently released during lamp manufacture. Owing to the clamping action of the elastic tongues, the discharge vessel retains its position in the outer bulb, also when the discharge vessel is not held by additional means. The outer bulb may then be held in a position as required when it is being heated locally so as to seal it off around the conductors which issue to the exterior from this bulb.

The clamping plate offers those skilled in the art a wide scope for determining the desired spring characteristics for each type of lamp in a few experiments through the choice of the material thickness and length of the resilient tongues. The elastic tongues not only render lamp assembly easier, because they hold the discharge vessel with clamping force in the outer bulb, and form a buffer in the case of shocks, but they also compensate for differences in expansion between the clamping plate, for example made of molybdenum, and the outer bulb, for example made of quartz glass, at the operational temperature of the lamp. In addition, they allow for tolerances in the diameter of the outer bulb in spite of these functions.

In a favourable embodiment, rigid portions project from the clamping plate distributed over the circumference thereof, which rigid portions are tangent to an imaginary circle which fits with clearance in the outer bulb. The body of the clamping plate itself must not be touched by the outer bulb circumferentially, which is accordingly true also for all rigid projecting portions thereof. High temperatures during lamp operation could give rise to compression stresses in the outer bulb, owing to the differences in expansion, which may lead to fractures. The elastic tongues keep rigid portions separated from the outer bulb, but these portions do limit the maximum lateral movement which the discharge vessel is capable of performing in the case of a shock. They also form an additional guarantee that the discharge vessel has and retains a centered position. The imaginary circle preferably is not smaller than is necessary for preventing stresses which involve the risk or fracture from arising in the outer bulb at operational temperature, given the tolerance on the internal dimension of the outer bulb which is to be accepted. In the case of a quartz glass outer bulb and a clamping plate made of molybdenum, the clearance of the clamping plate in the outer bulb, i.e. the difference in diameter between the imaginary circle and the inner diameter of the outer bulb, preferably is at most 3% of the outer diameter of the outer bulb. This is because the accuracy of the inner diameter of a glass outer bulb is dependent on the outer diameter.

It is favourable when the elastic tongues have convex bulges with which they press against the outer bulb. These bulges facilitate the insertion of the discharge vessel into the outer bulb and the gliding of the elastic tongues along the outer bulb wall. In addition, the risk of scratches in the outer bulb is counteracted, which scratches could arise if the tongues were to glide with sharp edges along said wall.

The clamping plate may have various shapes. In an embodiment, the clamping plate is substantially rectangular and the elastic tongues are present at two mutually opposed ranged rims. A conductor extending alongside the discharge vessel through the outer bulb can then easily pass the clamping plates at a side of the rectangle. The plates need not have openings then through which said conductor is to be passed. In a favourable modification, the elastic tongues are present at the ranged rims at the short sides of the rectangle. This version has the advantage that it offers comparatively much space to said conductor, while still the points of contact of the elastic tongues to the outer bulb are evenly distributed over the circumference.

In an embodiment in which the clamping plate is extra stiff and extra resistant to deformations, the clamping plate has L-shaped projections which each extend along two adjacent flanged rims. These projections offer a reinforcement exactly where a flanged rim ends.

Owing to its construction, the high-pressure discharge lamp according to the invention is eminently suitable for use in an optical system such as, for example, in a projection device in which the positions of the electrodes in the device, and accordingly the positions of the electrodes relative to a point of reference outside the lamp, for example a lamp cap, if present, are important.

The outer bulb may have various shapes, for example cylindrical or partly spherical with cylindrical portions on either side. It may be useful, if the outer bulb is spherical in the vicinity of the electrodes, to keep its temperature during lamp operation comparatively low. An outer bulb with a spherical portion also renders the introduction of the discharge vessel easy in that the discharge vessel then covers a portion of the path to be covered in the outer bulb without friction or with a lower friction of the elastic tongues against the wall of the outer bulb. This is also the case in a special embodiment wherein the outer bulb has a narrowed cylindrical zone in each of the cylindrical portions, against which zone the elastic tongues of a respective clamping plate press.

BRIEF DESCRIPTION OF THE DRAWINGS

An embodiment of the high-pressure discharge lamp according to the invention is shown in the drawing, in which.

DETAILED DESCRIPTION OF THE PREFERRED EMBODIMENTS

Figure 1:
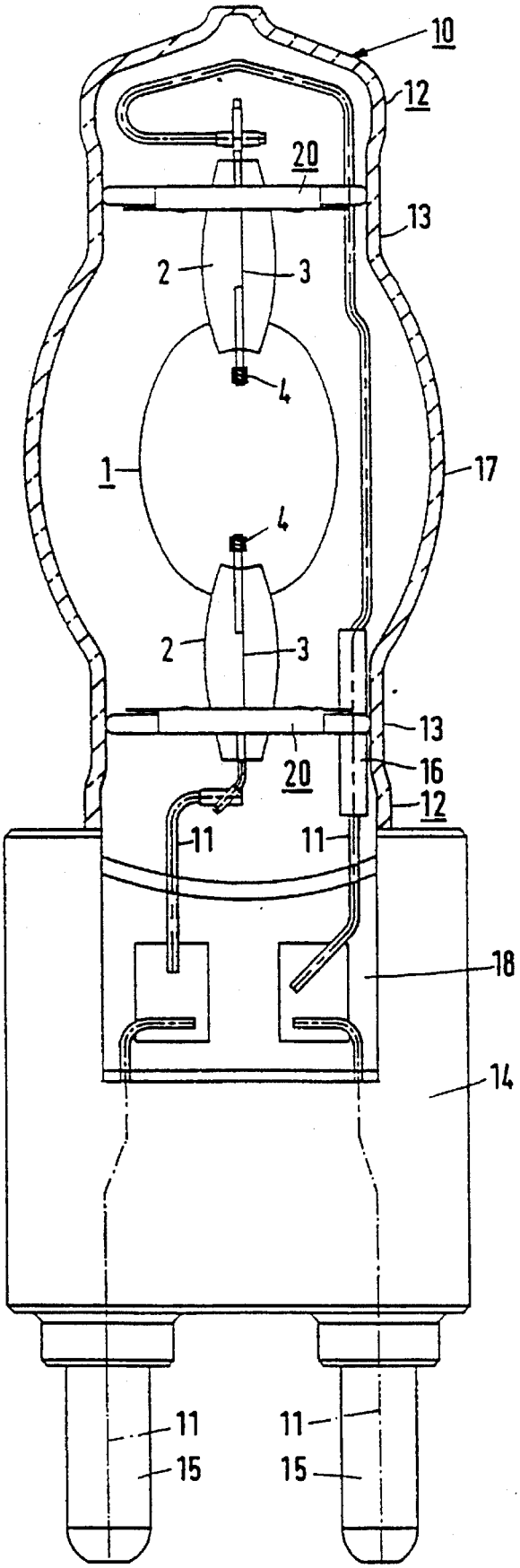
FIG. 1 shows a lamp partly in side elevation, partly in cross-section.

In FIG. 1, the high-pressure discharge lamp has a quartz glass discharge vessel 1 which has mutually opposed seals 2 through each of which a molybdenum current conductor 3 extends to a respective tungsten electrode 4 which is arranged in the discharge vessel. An outer bulb 10 is present, also of quartz glass in the Figure, but in alternative embodiments made of, for example, hard glass, around the discharge vessel, from which outer bulb conductors 11 each connected to a corresponding current conductor 3 issue to the exterior. A molybdenum clamping plate 20 is present on each seal 2, which clamping plate has a central opening 21 (FIGS. 2–4) through which the relevant seal is passed. Sets of mutually opposed tags 22, 22', 22" securely hold the seal 2 along said opening. A profile, such as projections, may be present on the seal 2, over which profiles the clamping plate is clicked during assembly, so that the plate occupies a defined position on the discharge vessel. Elastic tongues 23 extend away from the clamping plate and press with clamping force against a cylindrical portion 12 of the outer bulb 10. The lamp shown has a ceramic lamp cap 14 with contacts 15 connected to respective conductors 11. The discharge vessel has an ionizable filling which comprises, for example, rare-earth bromide, mercury, mercury bromide, cesium iodide, and rare gas.

Figure 2:
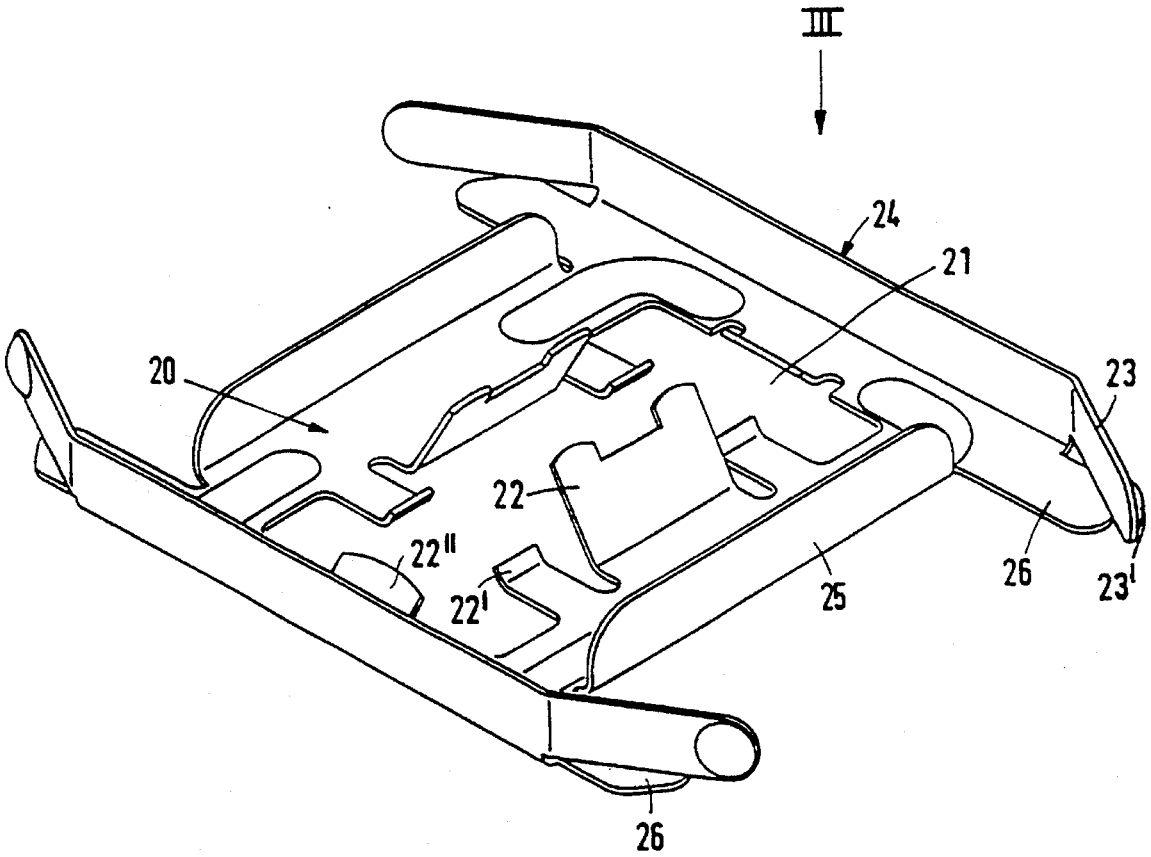
FIG. 2 shows a clamping plate of FIG. 1 in perspective view.
Figure 3:
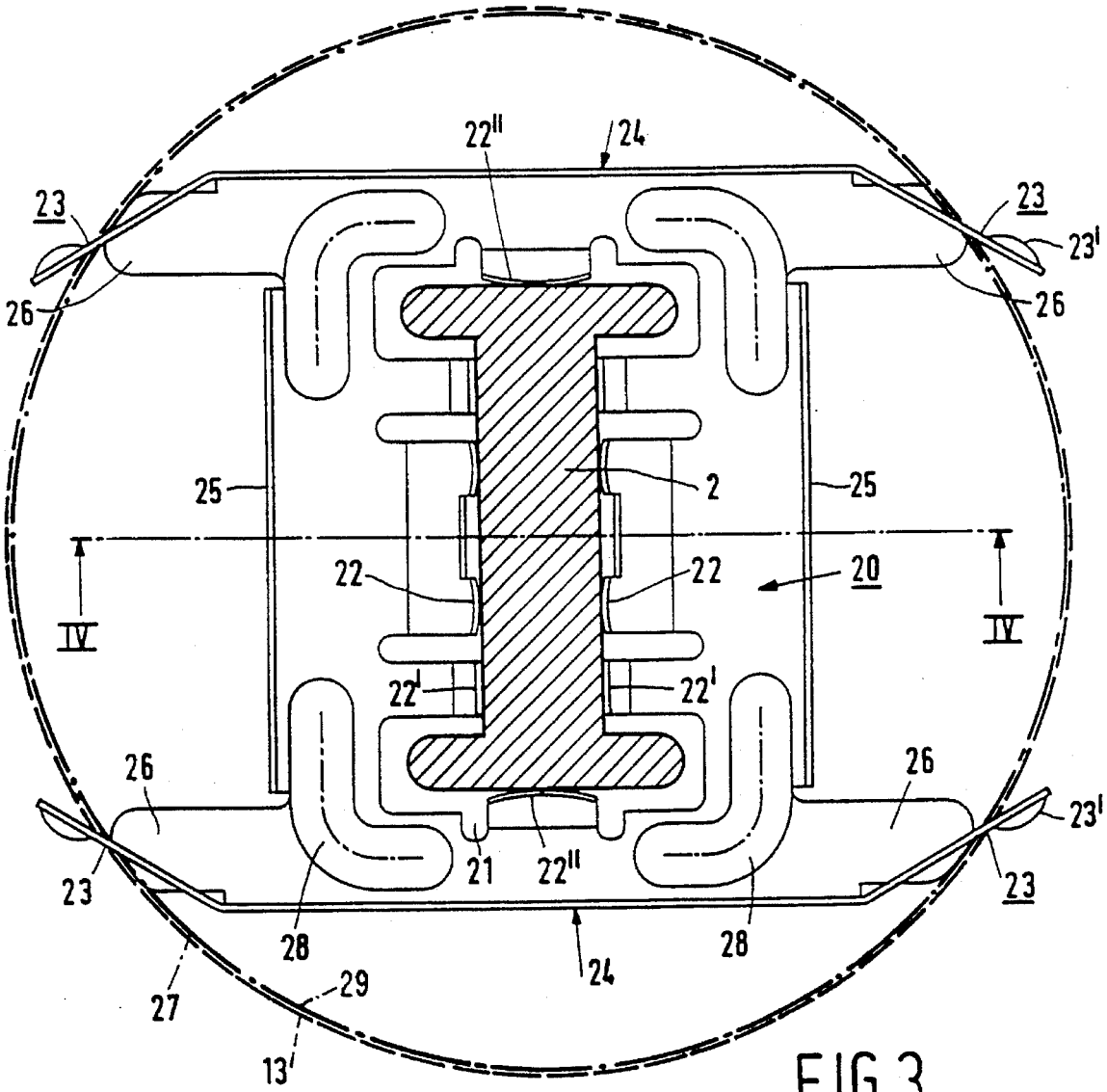
FIG. 3 is a plan view of the clamping plate of FIG. 2 along III.
Figure 4:
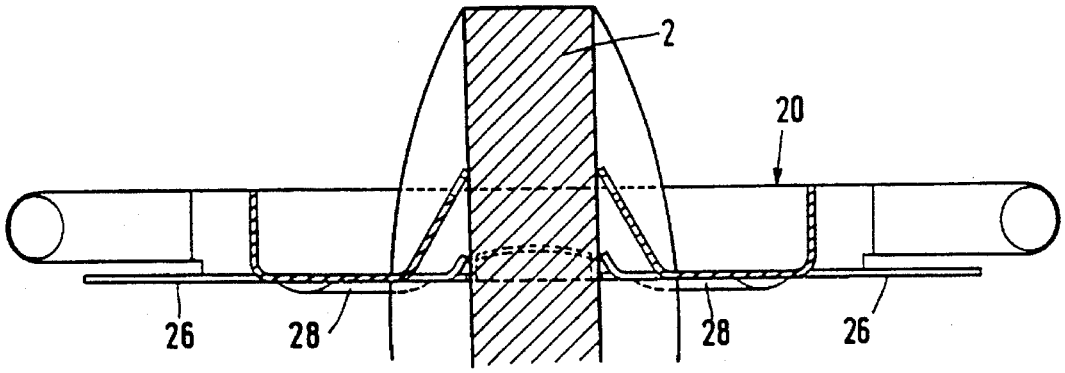
FIG. 4 is a cross-section taken on IV—IV in FIG. 3.

FIGS. 2–4 show that the clamping plate 20 has transversely flanged rims 24, 25 from which the elastic tongues 23 extend towards the outer bulb 10 in a substantially tangential direction (see also FIG. 1). The elastic tongues bear with clamping force on the outer bulb.

The elastic tongues 23 have convex bulges 23 with which they press against the outer bulb 10.

The clamping plate 20 is substantially rectangular, and the elastic tongues 23 are present at two mutually opposed flanged rims 24, in the Figures at the flanged rims 24 situated at the short sides of the rectangle. The long sides of the rectangle offer ample space for a long conductor 11 which extends to adjacent the top of FIG. 1. The long conductor is locally provided with an insulating sleeve 16, for example made of ceramic material or glass, as an additional security that no flashover from this conductor via the clamping plate to the other conductor will take place.

Rigid portions 26 project from the clamping plate 20 distributed over the circumference thereof, which portions are tangent to an imaginary circle 29 which fits with clearance in the outer bulb 10. FIG. 3 shows the inner surface of the outer bulb at the area of the relevant clamping plate in a finished lamp by means of a full-line circle 13. FIGS. 2–4, however, show the clamping plate without the outer bulb being present. The elastic tongues 23 in that case project through the circle 13. Said tongues accordingly are elastically deformed in the outer bulb, so that they bear on the outer bulb with clamping force.

The clamping plate has L-shaped projections 28, each extending along two adjacent flanged rims 24, 25. The projections thus reinforce the clamping plate over its diagonals.

The cylindrical portions 12 of the outer bulb 10 each have a narrowed cylindrical zone 13 on which the elastic tongues 23 bear with clamping force. As a result of this, and owing to the spherical main portion 17 of the outer bulb, the discharge vessel 1 may be readily inserted. Thanks to the clamping plates 20, the discharge vessel retains its position in the outer bulb without additional support during assembly of the lamp, also before the seal 18 of the outer bulb is made and the conductors 11 assume a supporting function.

FIGS. 3 and 4 show the contours of the relevant seal 2 of the discharge vessel 1. The major tags 22 which face one another are supported in their clamping action by two pairs of minor tags 22'. In addition, tags 22" press against side faces of the seal.

We claim:

1. A high-pressure discharge lamp comprising a discharge vessel having mutually opposed seals, a pair of discharges electrode arranged in the discharge vessel, and a respective current conductor extending to each said electrode;

around the discharge vessel, an outer bulb from which conductors connected to respective ones of said current conductors issue to the exterior;

a respective metal clamping plate on each seal, each clamping plate having a central opening through which the relevant seal extends and mutually opposed tags along said opening which hold the seal securely, elastic tongues extending away from the clamping plate and resting against a cylindrical portion of the outer bulb, characterized in that:the clamping plate has rims flanged transversely thereto, from which rims the elastic tongues extend in a direction towards and substantially tangential to the outer bulb, and the elastic tongues press with clamping force against the outer bulb.

2. A high-pressure discharge lamp as claimed in claim 1, characterized in that rigid portions project from the clamping plate and are distributed over the circumference thereof, and said rigid portions are tangent to an imaginary circle which fits with clearance in the outer bulb at the location of the clamping plate.

3. A high-pressure discharge lamp as claimed in claim 2, characterized in that the elastic tongues have convex bulges pressing against the outer bulb.

4. A high-pressure discharge lamp as claimed in claim 2, characterized in that the clamping plate is substantially rectangular, said rims including two mutually opposed flanged rims, and the elastic tongues are present at said two mutually opposed flanged rims.

5. A high-pressure discharge lamp as claimed in claim 2, characterized in that the clamping plate is substantially rectangular with short sides and long sides, and the elastic tongues are present at the flanged rims at the short sides of the rectangle.

6. A high-pressure discharge lamp as claimed in claim 2, characterized in that the clamping plate is substantially rectangular with two adjacent flanged rims, and the clamping plate has L-shaped projections which each extend along said two adjacent flanged rims.

7. A high-pressure discharge lamp as claimed in claim 4, characterized in that the cylindrical portions of the outer bulb have respective narrowed cylindrical zones against which the elastic tongues press.

8. A high-pressure discharge lamp as claimed in claim 1, characterized in that the elastic tongues have convex bulges pressing against the outer bulb.

9. A high-pressure discharge lamp as claimed in claim 1, characterized in that the clamping plate is substantially rectangular, said rims including two mutually opposed flanged rims, and the elastic tongues are present at said two mutually opposed flanged rims.

10. A high-pressure discharge lamp as claimed in claim 1, characterized in that the clamping plate is substantially rectangular with short sides and long sides, and the elastic tongues are present at the flanged rims at the short sides of the rectangle.

11. A high-pressure discharge lamp as claimed in claim 1, characterized in that the clamping plate is substantially rectangular with two adjacent flanged rims, and the clamping plate has L-shaped projections which each extend along said two adjacent flanged rims.

12. A high-pressure discharge lamp as claimed in claim 1, characterized in that the cylindrical portions of the outer bulb have respective narrowed cylindrical zones against which the elastic tongues press.

13. A high-pressure discharge lamp as claimed in claim 2, characterized in that the cylindrical portions of the outer bulb have respective narrowed cylindrical zones against which the elastic tongues press.

14. A high pressure discharge lamp, comprising:

an outer envelope;

a discharge device within said outer envelope energizeable for emitting light, said discharge device including a seal;

means for connecting said discharge device to a source of electric potential outside of said lamp envelope; and positioning means for positioning said discharge device within said outer envelope, said positioning means including a clamping plate holding said seal, said clamping plate having a plate portion with an opening through which said seal extends, clamping tags adjacent said central opening for securing said seal in said opening, and flanged rims transverse to said plate portion, said flanged rims including a plurality of elastic tongues extending toward and substantially tangentially to said outer envelope, said elastic tongues being biased against said outer envelope.

15. A high pressure discharge lamp according to claim 14, wherein said clamping plate further includes a plurality of rigid portions for limiting the excursion of said clamping plate relative to said outer envelope.

* * * * *